United States Patent [19]

Dennis et al.

[11] Patent Number: 4,643,002

[45] Date of Patent: Feb. 17, 1987

[54] CONTINUOUS METERED FLOW MULTIZONE AIR CONDITIONING SYSTEM

[75] Inventors: Richard D. Dennis, Bridgeport; Theodore L. Woollis, Clay, both of N.Y.

[73] Assignee: Carrier Corporation, Syracuse, N.Y.

[21] Appl. No.: 780,465

[22] Filed: Sep. 26, 1985

[51] Int. Cl.[4] ..... F25B 39/02

[52] U.S. Cl. ..... 62/525; 62/117; 137/599

[58] Field of Search ..... 62/524, 525, 498, 222, 62/527, 117; 137/599

[56] References Cited

U.S. PATENT DOCUMENTS

| | | | |
|---|---|---|---|
| 2,053,945 | 9/1930 | Cowin | 62/117 |
| 2,966,044 | 12/1960 | Mitchell | 62/217 |
| 3,818,717 | 6/1974 | Peruglia | 62/217 |
| 3,842,616 | 10/1974 | Orbesen | 236/92 B X |
| 4,032,070 | 6/1977 | Nielsen | 236/92 B |
| 4,342,421 | 8/1982 | Widdowson | 236/92 B |

*Primary Examiner*—William E. Wayne

*Attorney, Agent, or Firm*—Dana F. Bigelow

[57] ABSTRACT

In a multizone air conditioning system, a controlled leakage of refrigerant is provided from the high pressure side of the system to an inactive fan coil circuit to raise the pressure therein, such that when that circuit is later brought into an active state, the flow rate of refrigerant suddenly entering the circuit, and the resultant noise, is reduced. In one embodiment the controlled leakage is provided by an orifice formed between the high and low pressure sides of a valve, while in another it is provided by capillary tubes interconnected between active and inactive fan coil circuits.

7 Claims, 5 Drawing Figures

CONTINUOUS METERED FLOW MULTIZONE AIR CONDITIONING SYSTEM

BACKGROUND OF THE INVENTION

This invention relates generally to air conditioning systems and, more particularly, to piping and valving arrangements for the continuous metered flow of refrigerant in a multizone air conditioning system.

In a multizone air conditioning or heat pump system, where multiple indoor coils are used in combination with a single outdoor coil, it is common practice to provide valves at each end of the individual fan coil circuits so that, at any one time, any of the fan coil circuits may be effectively removed from the active system by simply closing its associated valves. It is thus common in such systems that, at any one time, one or more fan coil circuits are in such an inactive status while one or more other fan coil circuits are operating as part of the active system. It is also common to periodically interchange the active and inactive fan coil circuits by the opening and closing of their associated valves.

Heretofore, the manufacturers of multizone air conditioning or heat pump systems have strived to obtain high quality valves with little or no leakage so as to thereby completely shut off refrigerant flow to a particular fan coil when its thermostat was satisfied. The reason for this was that a leaking solenoid would cause refrigerant and its entrained oil to be trapped in the isolated circuit to thereby remove the oil from the active circuit where it was needed for the proper lubrication of the compressor. Although this problem may be somewhat alleviated by the use of high quality valves that have very little leakage, there is an associated problem which is exacerbated by this practice. That is the problem of noise which is caused to occur when such a valve is opened and the refrigerant rushes from the high side to the low side of the valve.

When a fan coil circuit is in an inactive state with its associated valves closed, there is little, if any, refrigerant in the circuit and that circuit is therefore under a low pressure condition. On the other side of the control valve which separates that circuit from the high pressure side of the active system, however, there is a high pressure condition. Thus, when that valve is opened to bring the inactive coil circuit into an active status, the sudden pressure drop across the valve causes a rapid flow of refrigerant and a substantial resultant noise which tends to be conducted along the insulated refrigerant line(s) to the fan coil(s) within the building. These temporary, but reoccurring, noises tend to be amplified by the fan coil(s) and can be annoying to anyone in the immediate area.

It is therefore an object of the present invention to provide a multizone air conditioning system with reduced operational noise.

Another object of the present invention is the provision in a multizone air conditioning system for reducing the occurrence of trapped oil in an inactive coil circuit while, at the same time, minimizing the noise caused by the opening of valves.

Still another object of the present invention is the provision in a multizone air conditioning system for accommodating the periodic opening of fan coil valves without any appreciable noise effects.

Yet another object of the present invention is the provision in a multi-fan coil air conditioning apparatus for quietly and efficiently bringing fan coil circuits into and out of the active mode during periodic intervals.

Still another object of the present invention is the provision for a multizone air conditioning system which is economical to manufacture and extremely functional in use.

These objects and other features and advantages become more readily apparent upon reference to the following description when taken in conjunction with the appended drawings.

SUMMARY OF THE INVENTION

Briefly, in accordance with one aspect of the invention, a fan coil circuit is connected, during a period of inactive status, to the high pressure side of the active system. A metering orifice is placed in the interconnecting network such that a controlled amount of refrigerant will leak from the high pressure side into the inactive fan coil circuit to thereby increase the pressure therein. This increased pressure will reduce the pressure drop across the circuit's high pressure valve, such that when that valve is subsequently opened to place the fan coil circuit in an active status, the resultant sudden refrigerant flow into the circuit will not be so rapid as to cause any appreciable noise.

In accordance with another aspect of the invention, the metering function within the interconnecting network is provided by an orifice formed in the high pressure valve to provide the control leakage on a continuous basis during operation in the heating mode of a heat pump system. The orifice is of a predetermined diameter which is selectively chosen to minimize any resulting efficiency losses while bringing about the desired pressure drop across the high pressure valve. The continuous flow of refrigerant through the isolated circuit also tends to flush out any oil that may be otherwise trapped within that circuit.

By yet another aspect of the invention, the noise abatement feature works during the cooling cycle as well. In this mode, the interconnecting network is provided by one or more relatively small capillary tubes which are connected to the respective fan coil circuits and lead to a common line which connects to the condenser coil. Although the tubes are primarily provided for bleeding off leakage refrigerant from inactive fan coils during the heating cycle, because of their location on the fan coil circuit side of the high pressure valves during the cooling cycle, they provide a metered fluid communication between the relatively high pressure active fan coil circuit(s) and the low pressure inactive fan coil circuit(s). This refrigerant flow provides the desired increased pressure in the inactive fan coil circuit to thereby alleviate the noise which would otherwise result when the high pressure valve is opened to place that circuit in the active status.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
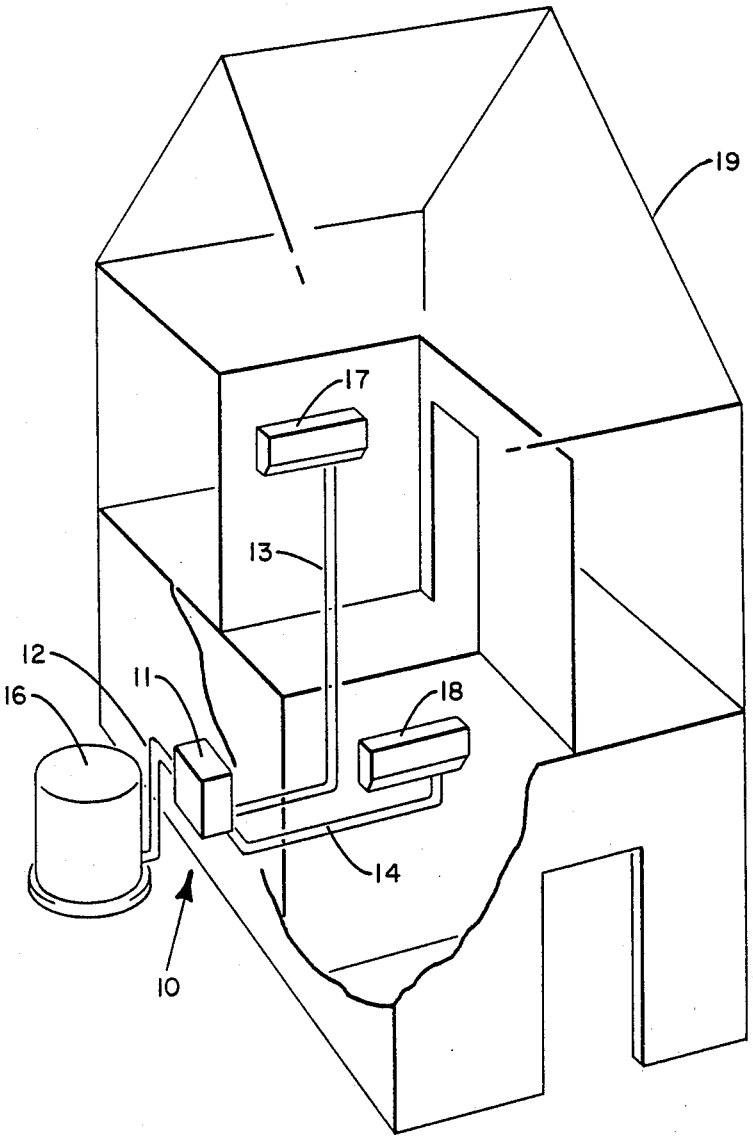
FIG. 1 is a perspective view of an installed multizone heat pump system with the present invention incorporated therein.

Referring now to FIG. 1, the invention is shown generally at 10 as incorporated in a control box 11 which is fluidly and electrically interconnected, by lines shown generally at 12, 13 and 14, between an air conditioning outdoor section 16 and the indoor fan coils 17 and 18. The system is installed in a building 19 where it is desired to have independent control and operation of the individual heating and air conditioning units within the various rooms of the building 19. For example, in the installation as shown, each of the individual fan coils 17 and 18 have their own thermostats (not shown) located in their respective rooms, and the associated fan coils 17 and 18 are responsively operated, independent from each other, to provide heating or cooling to their respective rooms as required to meet the demands indicated by their respective thermostats. Thus, it may be that both of the fan coils 17 and 18 are operating simultaneously in either the cooling or heating mode, or that, while one of the fan coils 17 or 18 is operating in the cooling or heating mode, the other fan coil is turned off.

While the present invention is being described in terms of use with a heat pump system it should be understood that it is also applicable for use with an air conditioning system. Accordingly, the term "air conditioning" as used herein should be construed broadly to include either a heat pump system or an air conditioning system which provides only a cooling function.

Aside from the manner of operation as described hereinabove, the fan coils 17 and 18 are of a rather conventional design and include: a refrigerant-to-air heat exchanger coil; a fan to circulate air from the room, across the heat exchanger coil, and back into the room; and a motor to drive the fan.

As will be seen in FIG. 1, the fan coil 17 is located at a higher elevation than the fan coil 18. Such an arrangement is common and desirable in multizone heat pump systems, but is the cause of differential refrigerant flow problems as discussed hereinabove. It is thus one of the design features included in the control box 11 to alleviate the problems associated with the differential elevations.

Another problem addressed by the apparatus within the control box 11 is that of differential fan coil capacities as discussed hereinabove. This occurs, for example, when the fan coil 17 and 18 are placed in different sized rooms or the primary use of the rooms is substantially different. For example, the heating/cooling requirements would be substantially different in (a) a room containing electronic devices such as computers or the like, (b) a kitchen with large ovens, and (c) a family room which is partially below ground level. It is thus desirable to match the size of the individual fan coils with the projected heating/cooling requirements of their particular rooms. The associated problems as discussed hereinabove must then also be addressed.

The outdoor section 16 is of a conventional design and includes a compressor, a heat exchange coil, a fan and drive motor. It will be recognized that the components of the outdoor section 16 must be sized for proper operation with all of the fan coils operating simultaneously, while at the same time being capable of operating with less than all of the fan coils in operation. For example, in a three fan coil system it may be quite common to operate with only one of those fan coils on while the others are effectively removed from the system.

Control for the multizone system is primarily provided by the control box 11 which is shown in FIG. 1 as being installed on the outer side of the building 19, near the outdoor section 16. It should be recognized, however, that this unit and/or the components contained therein may just as well be located within the outdoor section 16 or within the building 19, such as in the garage, a control room, or even between the outer and inner walls of the building.

Figure 2:
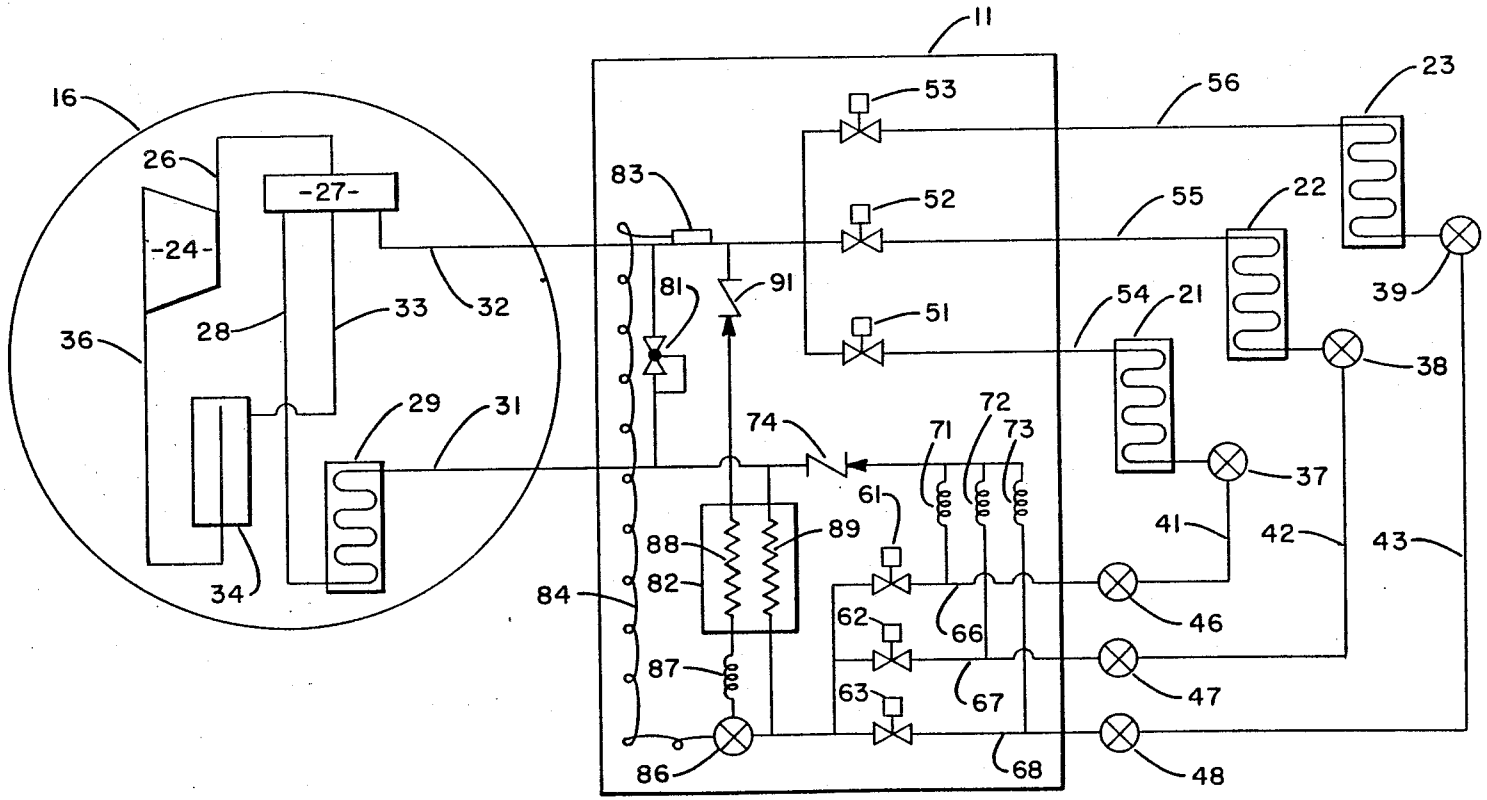
FIG. 2 is a schematic illustration of a multizone heat pump system with a preferred embodiment of the present invention incorporated therein.

Referring now to FIG. 2, there is shown a schematic illustration of the refrigerant flow apparatus and included components of the outdoor section 16, the control box 11, and the indoor fan coil units. While there are three such fan coils 21, 22 and 23 shown as equivalents, in design, purpose, and function, as the fan coils 17 and 18 described hereinabove, there may be more or less such fan coils in any particular installation. Further, although the fan coils 21, 22 and 23 are not pictorially distinguished in relative size or elevation, it should be understood that various sizing and elevational requirements may be imposed on the fan coil array to meet the various installation requirements. The control box 11 and the various components therewithin are designed to accommodate these requirements for variation.

Referring first to the outdoor section 16, the compressor is shown at 24 with its discharge line 26 connected to a four-way valve 27, which is operable in a conventional manner to selectively direct the flow of refrigerant to the outdoor coil or to one or more of the indoor coils to effect the cooling or heating cycle, respectively. Thus, during the cooling cycle the four-way valve 27 directs the flow of refrigerant along line 28 to the outdoor coil 29 where it is condensed, with its liquid passing along line 31, to the control box 11 where it is controlled in a manner to be described hereinafter. Liquid refrigerant is then expanded, passed through one or more of the indoor coils 21, 22 or 23, passed back through the control box 11, and finally returned to the four-way valve 27 by way of the return line 32. The refrigerant then passes along line 33 to the accumulator 34 and finally along the suction line 36 back to the compressor 24.

During the heating cycle, the four-way valve 27 passes the high pressure refrigerant along line 32 to the control box 11 where it is controlled in a manner to be described hereinafter, and then to one or more of the indoor coils 21, 22 or 23 where it is condensed to provide heat to the internal spaces. The resulting liquid refrigerant is then expanded and passed through the control box 11 for proper control. It then passes along line 31 to the outdoor coil 29 where it is evaporated, with the superheated vapor passing along line 29 to the four-way valve 27, then along line 33 to the accumulator 34, and finally along line 36 back to the compressor 24.

In either the cooling or heating mode as described hereinabove, it is necessary, in conventional refrigeration cycle operation, that the refrigerant be expanded during its flow between the condenser coil and the evaporator coil. Traditionally this function has been accomplished with various expansion devices such as capillary tubes or orifice plates. A more recently used expansion device has been that of the so-called "accurator" which is shown and described in U.S. Pat. No. 3,877,248 issued to F. J. Honnold on Apr. 15, 1975 and assigned to the assignee of the present invention. A later variation on this device is the so-called "bypass accurator", which is shown and described in U.S. Pat. No. 3,992,898 issued to R. J. Duell et al. on Nov. 23, 1976 and assigned to the assignee of the present invention. It is preferably such a bypass accurator which is used for the expansion devices in the present apparatus both for the cooling and heating modes of operation.

For expansion during the cooling mode, these expansion devices 37, 38 and 39 of the type mentioned above are placed in the respective lines 41, 42 and 43, just upstream from the respective fan coils 21, 22 and 23 as shown. When the flow reverses during the heating cycle, the expansion devices 37, 38 and 39 act in the bypass mode to effectively remove their expansion component from the circuit. The expansion process during the heating cycle is then accomplished by the expansion devices 46, 47 and 48 which are placed in the respective lines 37, 38 and 39 just upstream from the control box 11 as shown.

It should be mentioned, that for the heating cycle of such a split system, the expansion device is conventionally placed, similar to the expansion devices for the cooling cycle as shown, just upstream from the evaporator coil, i.e. in line 31 just upstream from the outdoor coil 29. However, in order to address the problem mentioned above, i.e. the reduction of flow of refrigerant from one or more of the fan coils 21, 22 or 23 when it is placed in a position of lower elevation than one or more of the other coils, the expansion process is accomplished in the individual lines 41, 42 and 43 prior to the coming together of the individual lines into a common line. In this way, because of the substantial pressure drop at the expansion devices 46, 47 and 48, there will be no significant reduction of flow from the lower elevation coil(s).

Recognizing the second problem as discussed hereinabove, i.e. that of required differential flow rates because of one or more of the fan coils 21, 22 and 23 being larger than the other(s), a further adaptation must be made. That is, while the placement of the expansion devices 46, 47 and 48 into the individual lines 41, 42 and 43 will solve the problems caused by elevational differences, it will tend to exacerbate the problems associated with differential coils sizes. To be more specific, because of the large pressure drop at the expansion devices 46, 47 and 48, it is at these points that the flow rates will be controlled, and the self-correcting feature, i.e., of the larger coil(s) having a greater head and therefore a greater flow, will be essentially lost. The solution found for solving this problem has therefore been to vary the size of the expansion devices 46, 47 and 48 in direct proportion to the size of the respective fan coils 21, 22 and 23. Thus, a larger fan coil will have a larger associated expansion device to thereby permit greater flow rates than its smaller counterparts, thereby preventing refrigerant backup in the larger unit(s). With the use of the accurator type expansion devices, this sizing step can be easily accomplished by simply choosing the insert pistons having the proper orifice size to match the size of the associated fan coil. For example, fan coils having capacities of 6,000, 8,000 and 13,000 BTU/hr. will be matched with orifices having diameters of 0.036", 0.037" and 0.040", respectively.

To understand the variable operational features of the system, the components and functions of the control box 11 will now be described. It will be understood that, in order to accomplish the objectives of the multizone heat pump system, it is necessary to be able to shut down, or effectively remove from the system, any one or more of the fan coils while permitting the other fan coil(s) circuit to operate in a normal manner. This is true for both the heating and cooling cycles. Such a shutting down function is accomplished with the use of solenoid valves 51, 52 and 53 connected by respective lines 54, 55 and 56 to the fan coils 21, 22 and 23 on the one side and by solenoid valves 61, 62 and 63 connected by respective lines 66, 67 and 68 to the expansion devices 46, 47 and 48 on the other side. When, for example, the room in which the fan coil 23 is installed reaches the desired temperature as determined by its associated thermostat, while the temperatures in the room associated with fan coils 22 and 21 have not yet been satisfied, the control circuitry will automatically close the solenoid valves 53 and 63 to thereby effectively remove that portion of the circuit from the system. Subsequently, and in a similar manner, the solenoid valves 52 and 62 will eventually be automatically closed to shut down the fan coil 22 and the solenoid valves 51 and 61 will be automatically closed to shut down the fan coil 21. During that time period, the solenoid valves 53 and 63 may or may not be opened to bring the fan coil 23 back into operation. Thus, in a system with three fan coils, there may at any time be anywhere from 0 to 3 fan coils in operation with the particular combination being frequently varied.

While in principle the solenoid valves completely isolate their associated fan coil when the valves are in the off position, in practice there has tended to be some leakage from the high pressure side and, over extended periods of time, that leakage can be substantial. For example, if, in the summertime, one room is not being used and its thermostat is therefore set at a high threshold temperature to prevent its fan coil from operating, while at the same time the other coils are periodically operational in the cooling mode there will be leakage of refrigerant from the high pressure side of the turned off solenoid valve, with the refrigerant flowing into the unused coil. There is, therefore, a removal of refrigerant from the active system to thereby lower the efficiency, but more importantly, there will be removed from the system a quantity of lubricant which settles from the stored refrigerant in the non-used coil, a condition which is undesirable because of its deprivation of required lubricant to the compressor 24.

During the cooling cycle, the problem of undesirable lubricant storage is largely alleviated by the use of solenoid valves 51, 52 and 53 with built in bypass features to allow for bleed-down of refrigerant and suspended lubricant back into the system. Such a valve is commercially available from the Sporlan Valve Co. as a Pilot Operated Solenoid Valve, Part Number CE9S240 shown, in part, in FIGS. 3, 4 and 5. In operation, when the leakage pressure in the fan coil reaches a predetermined threshold level, the bypass valve opens and allows refrigerant to re-enter the system via line 32.

If, during the cooling mode of operation, one of the valves 61, 62 or 63 has substantial leakage into an inactive circuit, then the bypass valve mentioned hereinabove will not be large enough to accommodate the return of refrigerant to the active circuit. That is, when the bypass flow in such a pilot operated solenoid valve becomes excessive, its intermediate piston or disk is caused to "chatter". This noise can be very undesirable, especially when it is amplified by the fan coil structures. Accordingly, the present invention addresses this problem by providing an orifice in the pilot operated solenoid valve such that a continuous flow of refrigerant can pass through the orifice to thereby relieve the bypass valve from its burdened flow and thereby eliminate the disk chatter. This feature will be more fully described hereinafter.

During the heating cycle it is the solenoid valves 61, 62 and 63 on the liquid side which would provide the bypass feature to allow the trapped refrigerant to reenter the system. However, because of the relatively smaller valves that are required in this location, and because of the liquid nature of the refrigerant at this point, the automatic bypass feature is not available. Accordingly, it is desirable to provide bleed-down capillary tubes 71, 72 and 73 for interconnecting respective lines 66, 67 and 68 to the commcn line 31 by way of a check valve 74. The capillary tubes 71, 72 and 73 act in a manner similar to the bypass valves mentioned above to allow for the pumpdown into the system of refrigerant tending to accumulate in any unused coil(s). The check valve 74 acts to isolate the capillary tubes 71–73 during the cooling cycle.

In addition to their use during the heating cycle as described above, the capillary tubes 71–73 are also active during the cooling cycle to provide a controlled leakage flow of refrigerant to inactive circuits to thereby eliminate the noise which would otherwise occur when that inactive circuit is brought into an active status. This feature will be more fully described hereinafter.

One of the characteristics of a multizone system is that of a mismatch of outdoor and indoor coil capacities when only a portion of the fan coils are being used. For example, during periods when the fan coils 21 and 22 are shut down and the fan coil 23 is operating in the heating mode, the active condenser surface is reduced by two thirds from full capacity operation. The resulting effect is to cause an increase in the discharge pressure in line 26 of the compressor 24. If some provision is not made to reduce that pressure, the high pressure control switch will be automatically activated to shut down the system. Accordingly, a hot gas bypass valve 81 is provided to interconnect the lines 32 and 31 as shown in FIG. 2. The valve 81 is a pressure regulated, single direction valve which senses the pressure in the high pressure side at line 32 to bleed back the high pressure side liquid to the low pressure side when the threshold pressures are reached. This bypassing of a portion of the refrigerant around the single fan coil 23 allows the compressor discharge pressure to remain at a reasonable level during periods of single fan coil operation.

During the cooling cycle, when the fan coils 21 and 22 (for example) are shut down and the fan coil 23 is operating as an evaporator there is again a reduction of active fan coil capacity. The effect in this mode, however, is to cause the active operating coil 23 to operate in a highly superheated condition. This, in turn, will cause the compressor to lose suction in line 36. Such a condition can, of course, be somewhat alleviated by the use of a bypass valve similar to the valve 81 described hereinabove, to simply bleed a portion of the liquid from line 31 back into the low pressure line 32. An improvement over that approach is to use a thermocharger 82 as shown in FIG. 2. The thermocharger 82, which is of the type shown in U.S. Pat. No. 4,316,366 issued to John D. Manning on Feb. 23, 1982 and assigned to the assignee of the present invention, has a remote sensing bulb 83 to sense the temperature in the low pressure line 32 and to transmit that temperature along line 84 to operate the thermal expansion valve 86. The thermal expansion valve 86 is connected to the thermocharger 82 by way of a capillary tube 87. The thermocharger 82 has heat exchanger coils 88 and 89 contained therein, in heat exchange relationship. Interconnected between the heat exchanger 88 and the line 32 is a check valve 91 to prevent flow of refrigerant into the thermocharger 82 during the heating cycle.

In operation, during the cooling cycle the refrigerant will pass from line 31 and through the heat exchange coil 89 before going to the fan coil(s) for evaporation. During periods when a single fan coil 23, for example, is in operation, the extent of the superheating condition will be sensed by the remote sensor 83 and when the temperature in line 32 reaches a predetermined level the thermal expansion valve 84 will be responsively opened. This will, in turn, cause a portion of the high pressure liquid refrigerant to be bled off from the line 92 to flow through the capillary tube 87, through the heat exchange coil 88, and be dumped back into the low pressure line 32 by way of the check valve 91. One resulting effect is to maintain the suction in line 36 going into the compressor 24 because of the liquid coolant that is being flashed off to the low pressure side 32. Another effect is to increase the efficiency of the operating fan coil 23 by subcooling the liquid refrigerant passing through the heat exchanger coil 89. In other words, the flashing off of the liquid refrigerant passing through the coil 88 tends to cool the refrigerant passing thereby in counterflow manner in the coil 89 such that there is an increase in the flow of refrigerant through the expansion device 39. An efficiency increase is therefore obtained, while at the same time, the suction to the compressor 24 is being maintained by the dumping of liquid refrigerant to the low pressure side.

Figure 4:
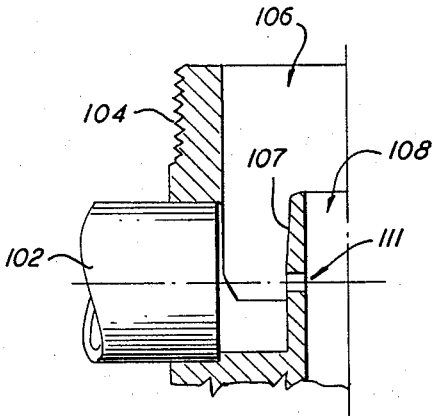
FIG. 4 is an enlarged view of the metering orifice portion thereof.
Figure 5:
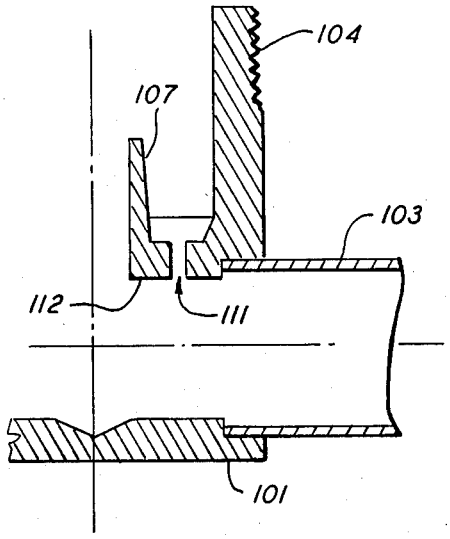
FIG. 5 is a sectional view of an alternative embodiment of the present invention.

In addition to the disk chatter noise that can occur in the solenoid valves 51, 52 and 53 during the cooling cycle, there can also be noise caused by operation of these valves during the heating cycle as set forth in the background discussion hereinabove. Accordingly, the solenoid valves 51, 52 sand 53 are modified to provide a controlled leakage flow of refrigerant both during the heating and cooling cycles. This modification is shown in FIGS. 3–5.

Figure 3:
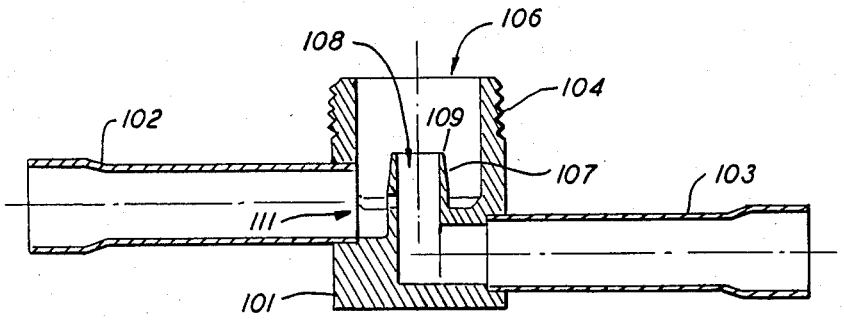
FIG. 3 is a longitudinal sectional view of a valve which has been modified in accordance with a preferred embodiment of the invention.

Shown in FIG. 3 is the body 101 of a commercially available Sporlan Valve Company pilot operated solenoid valve part number CE9S240 as modified in accordance with the present invention. The valve includes an inlet adapter 102 for connection to the high pressure line 32 of FIG. 2, and an outlet adapter 103 for connection to the low pressure line 54, 55 or 56 leading to the fan coils. The body 101 has a cylindrical portion 104 which defines a piston chamber 106 for receiving the piston or disk therein. Located concentrically within the piston chamber 106 is a central cylindrical structure 107 which defines the main flow port 108 at its inner diameter. The disk (not shown) operates in a conventional manner within the piston chamber 106 to rest on the upper surface 109 of the central cylindrical structure 107 when the valve is in the off position and to raise from that upper surface to allow the flow of refrigerant through the main flow port 108 when the valve is in the on position. As mentioned hereinbefore, when the valve was turned off during the cooling cycle, with the bypass feature (not shown) being relied on to bleed down the trapped refrigerant and included lubricant, the disk would tend to "chatter" or alternately move up and down on the upper surface 109 when the leakage flow into that inactive circuit was substantial. If the valve was allowed to remain open under these leakage conditions, The disk would still tend to flutter to thereby cause a noise.

The other problem previously mentioned was that of noise resulting from opening the valve to bring a previously inactive circuit into an active status for the heating mode. When this occurs, the high pressure gas in the inlet adapter 102 is suddenly caused to flow through the main flow port 108 to the outlet adapter 103 in which there is a low pressure condition. The resulting loud noise can then travel through the line and be amplified by the fan coil.

The present invention is designed to address both of the noise problems mentioned above. Formed in the side of the central cylindrical structure 107, near the inlet adapter 102, is an orifice 111, which can be better seen by reference to the enlarged view shown in FIG. 4. Since the orifice 111 is upstream from the flow controlling disk, in both the heating and cooling modes of operation, a continuous leakage flow is provided from the high pressure to the low pressure side of the valve. During the heating cycle then, the refrigerant is caused to flow, in a controlled manner from the inlet adapter 102, through the orifice 111, to the low pressure side, i.e. into the inactive circuit, to thereby reduce the pressure drop across the valve such that, when the valve is later opened to bring the circuit into the active status, the sudden pressure drop is not so great as to cause any significant noise. Thus, each of the solenoid valves 51, 52 and 53 are provided with such an orifice.

In the cooling mode, the orifice 111 acts to bleed back into the active circuit, by way of the inlet adapter 102, any refrigerant that has leaked into the inactive circuit from one of the valves 61, 62 or 63. In effect, the orifice 111 bypasses the bypass feature and therefore renders it essentially inactive. Accordingly, not only does the orifice 111 solve the problems associated with noise created in the solenoid valve, it makes the conventional bypass feature unnecessary.

Recognizing that the leakage of refrigerant along the bypass orifice 111 will cause a slight decrease in efficiency in the operating coil(s) during the heating cycle, the bypass orifice 111 is preferably sized to optimize the noise abatement effect while at the same time minimizing the efficiency losses. With the particular solenoid valves mentioned hereinabove, a leakage bypass orifice of 0.040" diameter has been found to be satisfactory in meeting these tradeoff requirements.

Referring now to FIG. 5, an alternative embodiment of the inventive orifice is shown. Instead of the orifice 111 being formed in the central cylindrical structure 107, it is formed in a longitudinal member 112 of the body 101 as shown. Such a location of the orifice 111 has been found satisfactory in achieving performance in the same manner as described for the FIG. 4 embodiment above.

It should be recognized that, one of the purposes of the orifice 111 is to solve the problem relating to noise associated with excessive leakage of one of the valves 61, 62 or 63, there are also noise associated problems resulting from a valve 61, 62 or 63 which has little or no leakage. This problem is essentially the same as that described hereinabove with respect to the solenoid valves 51, 52 and 53. That is, if there is little or no leakage into an inactive circuit, then when that circuit is later brought into use, the sudden flow of refrigerant into the low pressure areas will cause a loud sound. Accordingly, it is desirable to have a leakage flow into the inactive circuits during the cooling cycle as well. This can be accomplished by providing a control leakage orifice in the manner described hereinabove. However, it may also be provided by an alternative method of connecting the capillary tubes 71, 72 and 73 in the arrangement shown such that they are active during the cooling cycle for this purpose.

Inasmuch as the capillary tubes 71, 72 and 73 are downstream from the solenoid valves 61, 62 and 63 during the cooling cycle, there will tend to be some refrigerant flow from the operating or active circuit(s), through the capillary tubes, and into the non-active circuit(s). For example, assume that the solenoid valves associated with the fan coils 21 and 22 are turned off and that fan coil 23 is operating in the cooling mode. Then the lines 66 and 67 are isolated from direct fluid communication with the high pressure side by valve 61 and 62. But, because of the capillary tubes, they are not entirely isolated from the refrigerant flow. The capillary tubes 71 and 72 are operable to conduct refrigerant flow into the respective lines 66 and 67, because of the flow of refrigerant from the active coil 23 along line 68, and through the capillary tube 73. Any excess refrigerant built up in the fan coils 21 and 22 will, of course, be bled off by the orifices 111 in the solenoid valves 51 and 52 as described hereinabove, but the effect of the flow back of refrigerant into the line 66 and 67 is to increase the pressure therein and thereby reduce the pressure drop across the solenoid valves 61 and 62. Accordingly, when those valves are later opened to bring the respective fan coils 21 and 22 into use, the sudden pressure drop will not be as great as it otherwise would have been, and thus the resultant noise created by the sudden flow of refrigerant into the previously inactive circuit will be substantially reduced.

It will be understood that the present invention has been described in terms of preferred and alternative embodiments, but may take on any number of other forms while remaining within the scope and intent of the invention.

What is claimed is:

1. In a multizone air conditioning system of the type having a single outdoor coil and a plurality of indoor coil circuits with isolating valves on the respective high and/or low pressure sides thereof for selectively isolating said indoor coil circuits, a noise reduction arrangement comprising:

means for fluidly connecting one of said isolated coil circuits with the high pressure side of the active system; and pressure drop means within said connecting means to meter a flow of refrigerant to said isolated circuit to thereby reduce the pressure drop across the closed valve on the high pressure side thereof so that resulting noise will be reduced when the isolating valve is subsequently opened.

2. A noise reduction arrangement as set forth in claim 1 wherein said connecting and pressure drop means comprises a fluid conduit which bypasses the closed valve on the high pressure side of said isolated circuit, and further wherein said conduit is of a selected size to allow for a controlled volume of refrigerant to flow into said isolated circuit.

3. A noise reduction arrangement as set forth in claim 1 wherein said connecting means extends between an active indoor coil circuit and said isolated indoor coil circuit.

4. A noise reduction arrangement as set forth in claim 3 wherein said pressure drop means comprises at least one capillary tube.

5. An improved air conditioning system of the type having multiple indoor coil circuits and a common outdoor coil, each of said indoor coil circuits having high and low pressure valves at respective ends for selectively placing said circuit in alternate active and inactive states with respect to the active system, comprising:

controlled leakage means fluidly interconnecting each of said fan coil circuits with a high pressure side of the active system such that during periods of inactive states, said fan coil circuits will be provided with the metered flow of refrigerant to thereby reduce the pressure drop across the high pressure valve of that circuit such that resulting noise is reduced when said inactive circuit is made active.

6. An air conditioning system as set forth in claim 5 wherein said controlled leakage means comprises a fluid conduit of a predetermined size for bypassing the high pressure valve of an inactive indoor coil circuit.

7. An air conditioning system as set forth in claim 5 wherein said leakage means is interconnected between an active indoor coil and an inactive indoor coil circuit.

* * * * *